US010492580B2

(12) United States Patent
Ma

(10) Patent No.: US 10,492,580 B2
(45) Date of Patent: Dec. 3, 2019

(54) SHADE STRUCTURE

(71) Applicant: ACTIVA LEISURE INC., Zhejiang (CN)

(72) Inventor: Oliver Joen-an Ma, Zhejiang (CN)

( * ) Notice: Subject to any disclaimer, the term of this patent is extended or adjusted under 35 U.S.C. 154(b) by 0 days.

(21) Appl. No.: 16/084,636

(22) PCT Filed: Apr. 15, 2017

(86) PCT No.: PCT/CN2017/080687

§ 371 (c)(1),
(2) Date: Sep. 13, 2018

(87) PCT Pub. No.: WO2018/068492

PCT Pub. Date: Apr. 19, 2018

(65) Prior Publication Data

US 2019/0082802 A1 Mar. 21, 2019

(30) Foreign Application Priority Data

Oct. 16, 2016 (EP) ..... 16020403

(51) Int. Cl.
*A45B 25/14* (2006.01)
*A45B 25/06* (2006.01)
*A45B 25/02* (2006.01)

(52) U.S. Cl.
CPC ..... *A45B 25/14* (2013.01); *A45B 25/06* (2013.01); *A45B 25/02* (2013.01)

(58) Field of Classification Search
CPC ..... A45B 25/14; A45B 25/00; A45B 25/06; A45B 25/02
See application file for complete search history.

(56) References Cited

U.S. PATENT DOCUMENTS

| | | | | |
|---|---|---|---|---|
| 4,424,824 A | | 1/1984 | Becher | |
| 5,329,953 A | * | 7/1994 | Becher | A45B 19/04 135/31 |
| 5,386,842 A | * | 2/1995 | Becher | A45B 23/00 135/20.3 |
| 5,655,557 A | * | 8/1997 | Martin | A45B 23/00 135/15.1 |
| 5,752,534 A | * | 5/1998 | Becher | A45B 23/00 135/15.1 |

(Continued)

FOREIGN PATENT DOCUMENTS

| | | |
|---|---|---|
| CN | 101204263 A | 6/2008 |
| CN | 201813995 U | 5/2011 |

*Primary Examiner* — Noah Chandler Hawk
(74) *Attorney, Agent, or Firm* — Avery N. Goldstein; Blue Filament Law PLLC

(57) ABSTRACT

A shade is provided in the form of an umbrella which may be operated in the vicinity of other objects or in the middle of a table even if the canopy of the umbrella is large and the ribs of the umbrella are long. The height of the folded umbrella is relatively low. The mechanism of the umbrella is simple and may be manufactured at a comparably low cost. The operation of the umbrella is not complicated and is easily opened and closed. The shade has an upper hub fixed to a guide tube, which is telescopically disposed in and reciprocally movable relative to a uppermost end portion of the support tube. The guide tube and a slider, sleeve or runner are interconnected by flexible traction means in the form of a flexible traction member.

17 Claims, 5 Drawing Sheets

(56) References Cited

U.S. PATENT DOCUMENTS

| | | | | |
|---|---|---|---|---|
| 6,129,101 | A | 10/2000 | Dubinsky | |
| 6,854,474 | B1 | 2/2005 | Chen | |
| 7,438,077 | B1 * | 10/2008 | Wilson | A45B 25/14 135/20.1 |
| 7,900,643 | B2 * | 3/2011 | Ma | A45B 19/04 135/28 |
| 8,087,420 | B1 | 1/2012 | Lukacsy | |
| 8,555,906 | B2 * | 10/2013 | Ma | A45B 19/04 135/28 |
| 8,757,183 | B2 | 6/2014 | Volin | |
| 2005/0045217 | A1 | 3/2005 | Clarke | |
| 2012/0266927 | A1 * | 10/2012 | Lukacsy | A45B 23/00 135/20.3 |

* cited by examiner

SHADE STRUCTURE

FIELD OF THE INVENTION

The present invention concerns shade structures like umbrellas, in particular large free-standing umbrellas. Such umbrellas are often unfolded and folded manually by pushing a slider up- and downwards the mast of the umbrella. The length of the ribs of umbrellas usually depends on the size of the canopy. If the canopy is large, the ribs are very long. This leads to the unwanted situation that a large umbrella may not be folded or unfolded next to objects like garden furniture, because the ribs would collide with such items. Further, such umbrellas cannot be placed in the middle of a table, because the tabletop would prevent a complete folding or unfolding. In addition, items placed on the tabletop could be swept away at such an attempt.

BACKGROUND OF THE INVENTION

Simply extending the mast and thereby raising the top of the umbrella, where the ribs are connected, would not solve the problem. This would thus lead to a correspondingly higher position of the slider in the unfolded position of the umbrella, so that the umbrella could not be handled by persons with normal or even shorter length.

Another problem of large free standing umbrellas is that the bigger size of the canopy automatically leads to a higher weight of the ribs and/or the canopy. The unfolding and folding of the umbrella therefore becomes more difficult.

The U.S. Pat. No. 4,424,824 A discloses an umbrella having a support tube uppermost end portion into which is telescopically received an umbrella shaft carrying a crown to which is pivotally connected cover ribs, a sleeve in external telescopic relationship to the support tube, a plurality of struts pivotally connected between the sleeve and the cover ribs, a threaded spindle within the umbrella shaft threaded relative to a threaded nut fixed to the umbrella shaft, and a flexible element, such as a cable, rope or wire, having ends fixed to the sleeve and to the umbrella shaft and being guided over a pulley carried by the umbrella shaft. As a result, the procedure of opening and closing the umbrella canopy is very complex. The umbrella canopy is closed, while the umbrella shaft is extended, in others words, closing or opening the umbrella canopy and extending or retracting the umbrella shaft are working at the same time, namely the two actions are synchronous. The length of the guide tube extended outward from the support tube is very long, so the top of the closed umbrella will be very high. This is disadvantageous e.g. when storing the umbrella away, in particular under a roof or such. Also the known umbrella needs more space when closed for transport, which i.a. leads to higher costs for shipping. Additionally, in order to facilitate the opening and closing procedure, the overall operating-system of the known umbrella includes threaded means in the form of a threaded spindle supported in an undisplaceable or fixed fashion at a lower end portion by means of gear means in the form of a miter gear. This makes the fabrication of the known umbrella complicated, time consuming and costly. A more simple system for facilitating the folding and unfolding of an umbrella is known from the U.S. Pat. No. 8,087,420 B1, which discloses an umbrella system which includes a counterweight and system of pulleys, where the system of pulleys includes class 1 and class 2 pulleys configured with the counterweight to gain a mechanical advantage in the normal operation of the umbrella. This prior art, however, does not teach any solution or even discusses the problem of the long ribs at large canopies.

SUMMARY OF THE INVENTION

A shade structure is provided in the form of an umbrella with ribs, which are at one end pivotally connected to an upper hub, and struts supporting the ribs, at one end pivotally connected to the ribs and at their other end to a slider. The slider is movable upwards and downwards. A support tube, with an upper hub is fixed to an upper end of a guide tube, telescopically disposed in and reciprocally movable relative to a uppermost end portion of the support tube. At least one flexible traction member pulls a counterweight component, the counterweight component situated and movable within the support tube and moving upwards when the slider is being moved downwards on the support tube, whereby the upper end of the counterweight component comes in touch with the lower end of the guide tube, pushing the guide tube upwards and thereby lifting the upper hub and the ribs.

DETAILED DESCRIPTION OF THE INVENTION

Figure 1:
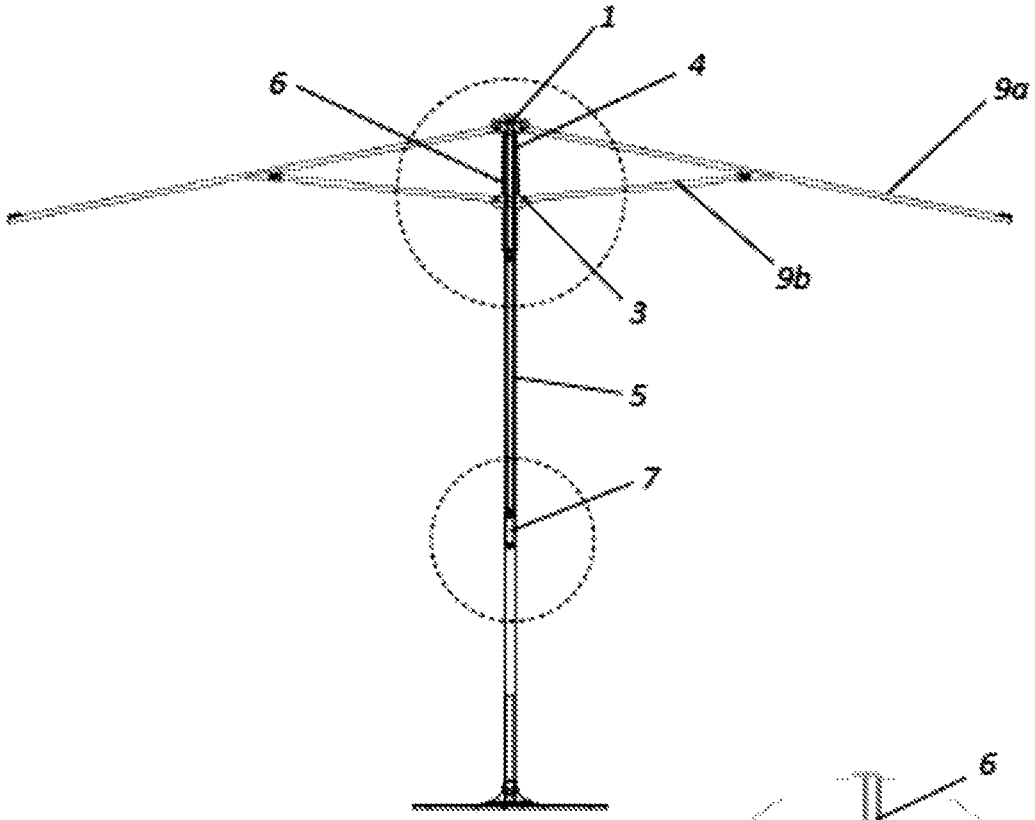
FIG. 1 shows a preferred embodiment of an umbrella according to the invention in an unfolded state.

The underlying technical problem of the present invention is to provide an umbrella which may be operated in the vicinity of other objects or in the middle of a table even if the canopy is large and the ribs of the umbrella are long. The height of the folded umbrella shall be relatively low. The mechanism of the umbrella shall be simple and easily to be manufactured at comparably low costs. The umbrella shall to be opened and closed easily.

This technical problem is solved by an umbrella according to the present invention. An upper hub is fixed to a guide tube, but not to a support tube as at the conventional umbrellas. The guide tube is telescopically disposed in and reciprocally movable relative to a uppermost end portion of the support tube. The guide tube and a slider, sleeve or runner are interconnected by flexible traction means in the form of a flexible traction member, e.g. a rope. Preferably the traction member may be guided by pulley means in form of a pulley secured to the upper end portion of the support tube. One end of the flexible traction member is firmly secured to the slider, the other is firmly secured to a counterweight component. It is advantageous, if the flexible traction member, e.g. a rope, passes through the counterweight component in the support tube, whereas both ends of the flexible traction member are firmly secured to the slider. Preferably the weight of the counterweight is determined in a way that the counterweight supports the upward movement of the slider and thereby facilitates the opening of the umbrella.

The operation of the shade structure according to the invention is even more facilitated by a second embodiment. There is added a free pulley system in order to save some force. This pulley system consists of an additional push rod, which is disposed telescopically in the support tube and the guide tube, and which is operated by the means of an additional traction member, e.g. a rope, which is guided by additional pulleys mounted at the guide tube and the support tube. When closing the umbrella, the counterweight component actuates the push rod, which pushes the guide tube upwards. Examples for carrying out the invention are shown in the drawings and are described in detail as follows.

Figure 3:
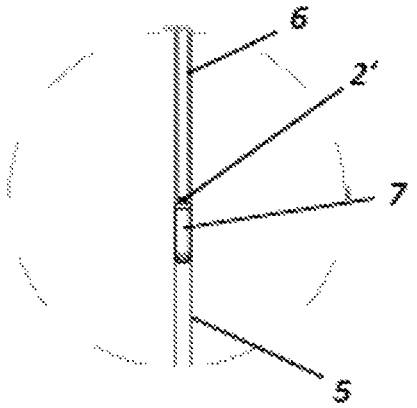
FIGS. 2 and 3 show details of this umbrella of FIG. 1.
Figure 2:
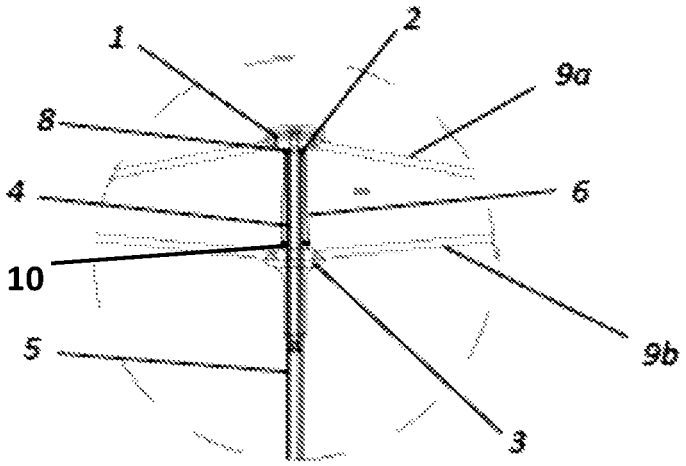

FIG. 1 shows a preferred embodiment of an umbrella according to the invention in an unfolded state. The FIGS. 2 and 3 show details of this umbrella. The umbrella has ribs (9*a*), which are at one end pivotally connected to an upper hub (1). Struts (9*b*) support the ribs (9*a*) and are at one end pivotally connected to the ribs (9*a*) and at their other end to a slider (3). The slider (3) can move up- and downwards a support tube (5). The upper hub (1) is fixed to the upper end of a guide tube (4). The diameter of the guide tube (4) is less than the diameter of the support tube (5), so that the guide tube (4) may be moved within the support tube (5). By this, the guide tube (4) is telescopically disposed in and reciprocally movable relative to a uppermost end portion (8) of the support tube (5). The slider (3) may be held in its most upper position by conventional means, e.g. by at least one or more pivotally mounted hooks (10), which protrude corresponding openings in the support tube (5). At least one end of at least one flexible traction member (6), e.g. a rope, is fixed to the slider (3). At the upper end portion (8) of the support tube (5), there is situated at least one pulley (2), which guides the traction member (6). The other end of the flexible traction member (6) may be fixed to a counterweight (7), which is situated and movable within the support tube (5). FIG. 1 shows a preferred embodiment of the invention, where both ends of a single traction member (6) are connected to the slider (3), and where the flexible traction member (6) is guided by the means of two pulleys (2) mounted at the upper end portion (8) of the support tube (5). In this preferred embodiment, there the counterweight component (7) has a pulley (2'), over which the traction member (6) is guided. Thus, the possible danger of a canting of the counterweight component (7) may be reduced.

Figure 4:
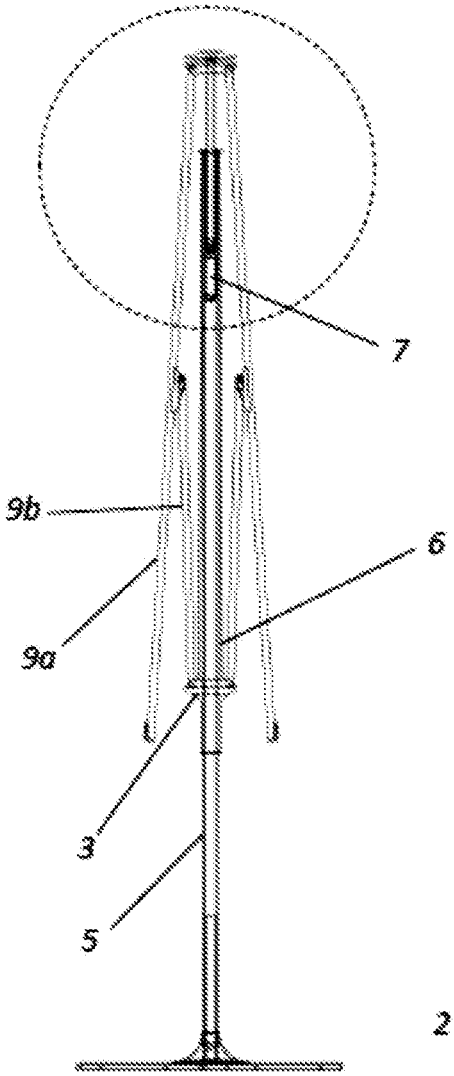
FIG. 4 shows the umbrella according to the invention in its closed position.
Figure 5:
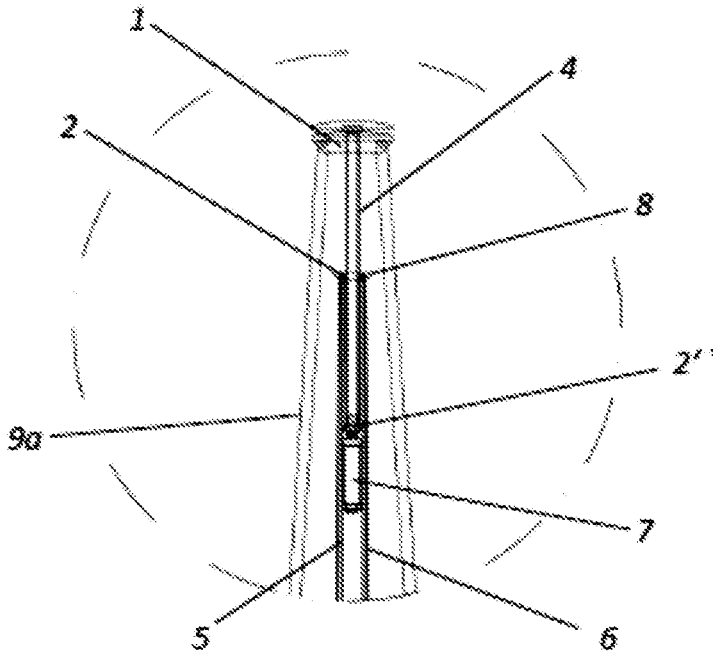
FIG. 5 shows a detail of FIG. 4.

When closing the umbrella, the slider (3) is moved downwards the support tube (5). By this, the slider (3) pulls the flexible traction member (6), so that the counterweight component (7) connected to the flexible traction member (6) is lifted upwards. When the upper end of the counterweight component (7) comes in touch with the lower end of the guide tube (4), the guide tube (4) is pushed upwards by the counterweight component (7). By this, the upper hub (1), which is connected to the guide tube (4), is lifted. This simultaneously causes a lift of the ribs (8), pivotally connected to the upper hub (1). FIG. 4 shows the umbrella according to the invention in its closed position, and FIG. 5 shows a detail thereof. It can easily be seen that the upper hub (1) and accordingly the ribs (9*a*) are raised in a way that the danger that objects under or in the vicinity of the umbrella come in touch with it in particular its ribs (9*a*) during the closing procedure is reduced substantially.

The weight of the counterweight component (7) should be chosen in dependence of the size and weight of the canopy and its ribs (9*a*) and struts (9*b*). It is in general possible to dimension the weight of the counterweight component in a way, that the counterweight may automatically pull the interconnected slider upwards. If so, it may be advantageous to provide additional openings in the support tube (5), into which hooks (10) of the slider (3) may intrude in the closed position of the umbrella, in order to secure the slider in this position.

Figure 6:
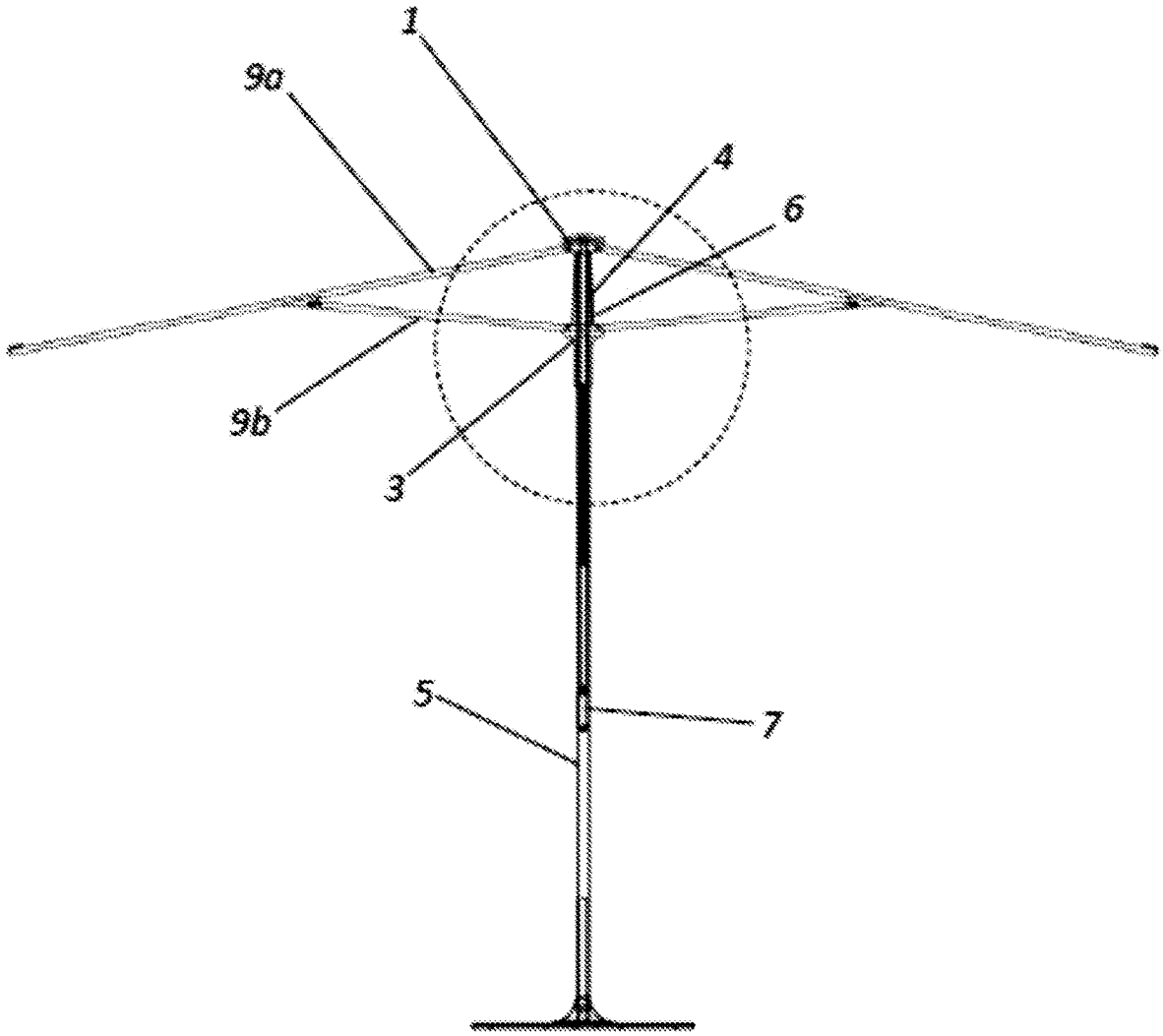
FIG. 6 shows the second embodiment of the invention.
Figure 7:
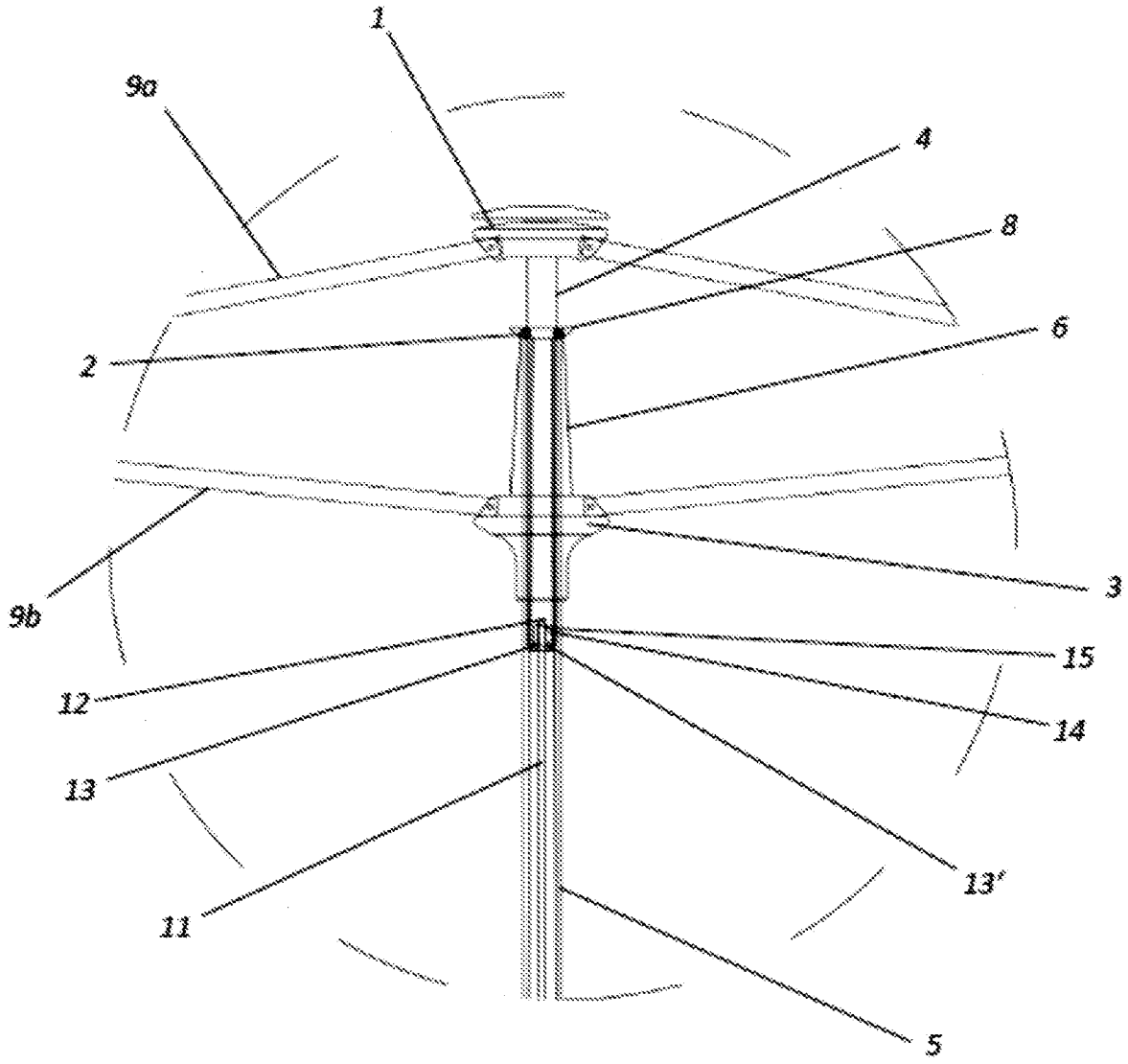
FIG. 7 shows a detail FIG. 6 during the process of opening/closing.
Figure 8:
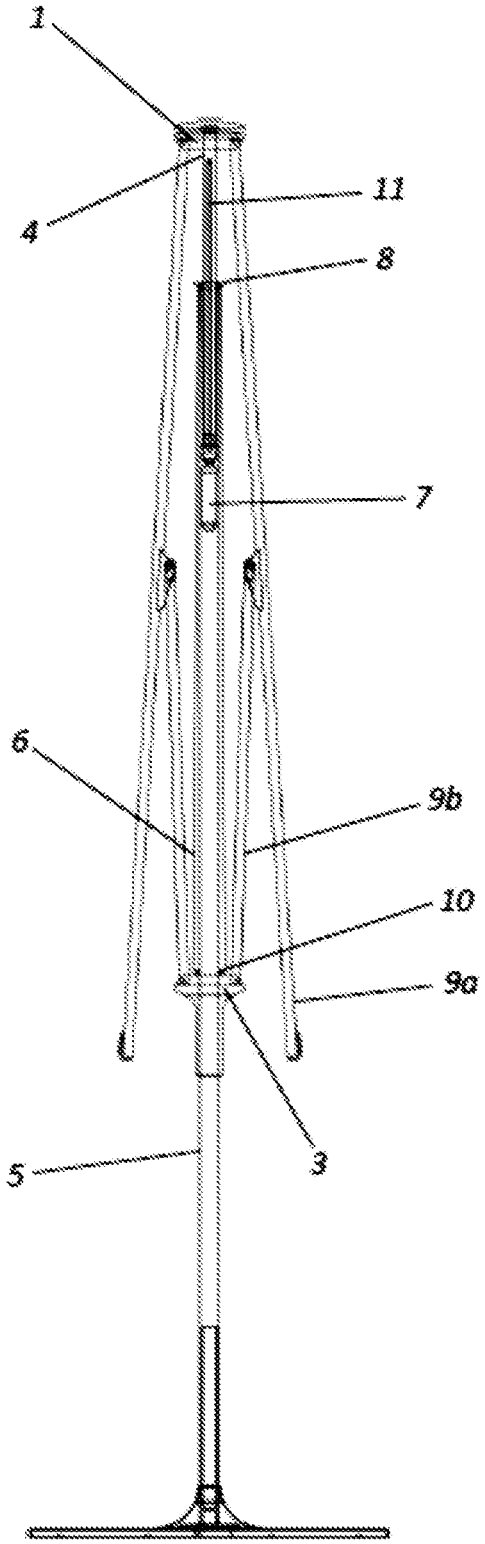
FIG. 8 shows an umbrella according to the second embodiment of the invention in a closed state.

FIG. 6 shows the second embodiment of the invention, and FIG. 7 shows a detail thereof during the process of opening/closing. There is added a free pulley system to save some force. The path of the rope (6) is the same as in the first embodiment. A push rod (11) is disposed telescopically in the support tube (5) and the guide tube (4). There are three pulleys (12), (13) and (13'). Pulley (12) is mounted on the push rod (11) on a pulley carrier (14), and the pulleys (13) and (13') are mounted in the guide tube (4) on a pulley carrier (14). One end of a second traction member, e.g. a rope (15), is firmly secured to the support tube (5). The other end of the rope (15) via the pulley (12) supported by the pulley carrier (14) and the pulleys (13) and (13') supported by the pulley carrier (16) is also firmly secured to the support tube (5). Namely the pulley (12) supported by the pulley carrier (14) is a free pulley. So, the rope (6) will pull the counterweight component (7) to be moved upwards, when the user pulls downwards the slider (3) directly or indirectly. The counterweight component (7) will touch and push the push rod (11) upwards. The guide tube (4) is raised by the push rod (11), and then the canopy will be slowly closed.

The invention claimed is:

1. A shade structure like an umbrella with ribs (9*a*), which are at one end pivotally connected to an upper hub (1), and struts (9*b*) supporting the ribs (9*a*), at one end pivotally connected to the ribs (9*a*) and at their other end to a slider (3), movable up- and downwards a support tube (5), with the upper hub (1) fixed to the upper end of a guide tube (4), telescopically disposed in and reciprocally movable relative to a uppermost end portion (8) of the support tube (5), characterized in that at least one flexible traction member (6) pulls a counterweight component (7), situated and movable within the support tube (5) and moving upwards when the slider (3) is being moved downwards the support tube (5), whereby the upper end of the counterweight component (7) comes in touch with the lower end of the guide tube (4), pushing the guide tube (4) upwards and thereby lifting the upper hub (1) and the ribs (9*a*).

2. The shade structure according to claim 1, characterized in that one end of the at least one flexible traction member (6) is fixed to the slider and the other end to the counterweight component (7).

3. The shade structure according to claim 1, characterized in that the at least one flexible traction member (6) is guided by at least one pulley (2), mounted at the upper end portion (8) of the support tube.

4. The shade structure according to claim 1, characterized in that the flexible traction member (6) passes through the counterweight component (7), whereas both ends of the flexible traction member are firmly secured to the slider (3).

5. The shade structure according to claim 4, characterized in that the counterweight component (7) has at least one pulley (2'), by which the lower portion of the traction member (6) is guided.

6. The shade structure according to claim 1, characterized in that the slider (3) being held in its most upper position by at least one pivotally mounted hook (10) or the like, which protrudes at least one corresponding opening in the support tube (5).

7. The shade structure according to claim 1, characterized in that the slider (3) is held in its lowered position by at least one pivotally mounted hook (10) or the like, which protrudes at least one corresponding opening in the support tube (5).

8. The shade structure according to claim 1, characterized in that the weight of the counterweight component (7) at least partially automatically lifts the slider (3) upwards the support tube (5).

9. A shade structure like an umbrella with ribs (9*a*), which are at one end pivotally connected to an upper hub (1), and struts (9*b*) supporting the ribs (9*a*), at one end pivotally connected to the ribs (9*a*) and at their other end to a slider (3), movable up- and downwards a support tube (5), with the upper hub (1) fixed to the upper end of a guide tube (4), telescopically disposed in and reciprocally movable relative to a uppermost end portion (8) of the support tube 5, characterized in that at least one flexible traction member (6) pulls a counterweight component (7), situated and movable within the support tube (5) and upwards when the slider (3) is being moved downwards the support tube (5), whereby the upper end of the counterweight component (7) comes in touch with the lower end of a push rod (11) disposed telescopically in the support tube (5) and the guide tube (4), whereby the upper end of the push rod (11) pushes the guide tube (4) upwards thereby lifting the upper hub (1) and the ribs (9*a*).

10. The shade structure according to claim 9, characterized in that the push rod (11) is supported by a free pulley system.

11. The shade structure according to claim 10, characterized in that the free pulley system consists of three pulleys (12), (13) and (13'), whereas pulley (12) is mounted on the push rod (11) on a pulley carrier (14) and the pulleys (13) and (13') are mounted in the guide tube (4) on a pulley carrier (14), with a traction member (15), which passes the pulley (12) supported by the pulley carrier (14) and the pulleys (13) and (13') supported by the pulley carrier (14), of which one end is secured to the support tube (5), the other end of the traction member (15) also being secured to the support tube (5).

12. The shade structure according to claim 11, characterized in that both ends of a single traction member (6), guided by the means of two pulleys (2) mounted at the upper end portion (8) of the support tube (5), are connected to the slider (3).

13. The shade structure according to claim 10, characterized in that both ends of a single traction member (6), guided by the means of two pulleys (2) mounted at the upper end portion (8) of the support tube (5), are connected to the slider (3).

14. The shade structure according to claim 9, characterized in that both ends of a single traction member (6), guided by the means of two pulleys (2) mounted at the upper end portion (8) of the support tube (5), are connected to the slider (3).

15. The shade structure according to claim 14, characterized in that the counterweight component (7) has a pulley (2'), by which the lower portion of the traction member (6) is guided.

16. The shade structure according to claim 9, characterized in that the slider (3) is held in its most upper position by at least one pivotally mounted hook (10) or the like, which protrudes at least one corresponding opening in the support tube (5).

17. The shade structure according to claim 9, characterized in that the slider (3) is held in its lowered position by at least one pivotally mounted hook (10) or the like, which protrudes at least one corresponding opening in the support tube (5).

* * * * *